United States Patent [19]

Acock, Jr.

[11] Patent Number: 4,637,176

[45] Date of Patent: Jan. 20, 1987

[54] ELEVATOR AIR LOCK

[75] Inventor: George W. Acock, Jr., Columbus, Ohio

[73] Assignee: James A. Rhodes, Columbus, Ohio

[21] Appl. No.: 786,995

[22] Filed: Oct. 15, 1985

[51] Int. Cl.[4] ..... B66B 9/00

[52] U.S. Cl. ..... 52/30; 52/169.6; 52/236.3; 52/2; 187/1 R

[58] Field of Search ..... 52/30, 236.3, 169.6, 52/2; 182/101, 141; 187/1 R, 6; 405/192, 185, 193, 188

[56] References Cited

U.S. PATENT DOCUMENTS

| | | | |
|---|---|---|---|
| Re. 12,300 | 1/1905 | Wills | 52/30 |
| 419,317 | 1/1890 | Coe et al. . | |
| 545,642 | 9/1895 | Ball . | |
| 1,890,570 | 12/1932 | Davis | 405/192 |
| 2,190,330 | 2/1940 | Martine . | |
| 2,532,268 | 11/1950 | Christmann . | |
| 2,787,139 | 4/1957 | Salazar . | |
| 3,412,509 | 11/1968 | Popil | 52/2 |
| 3,815,299 | 6/1974 | Sörensen et al. | 52/2 X |
| 4,122,685 | 10/1978 | Ruff | 52/30 X |
| 4,282,689 | 8/1981 | Royer | 52/79.6 |
| 4,375,735 | 3/1983 | Rhoads | 49/68 |

FOREIGN PATENT DOCUMENTS

| | | | |
|---|---|---|---|
| 956805 | 4/1964 | United Kingdom | 52/2 |
| 670698 | 6/1979 | U.S.S.R. | 52/2 |

*Primary Examiner*—J. Karl Bell

*Attorney, Agent, or Firm*—Beveridge, De Grandi & Weilacher

[57] ABSTRACT

An air lock or transition chamber for controlling air pressure during ingress and egress from a multi-story building the interior of which is at an elevated air pressure. An elevator car is provided with a substantially air-tight seal on its door. Persons entering the building pass through an entrance lobby or an underground garage and enter the elevator. These locations are at ambient atmospheric pressure. The elevator doors close and the elevator moves to the desired floor, which is at an elevated pressure. As the elevator car moves, the pressure within the elevator increases, either substantially to the elevated pressure of the destination or to a pressure between ambient atmospheric pressure and that elevated pressure. Similarly, as the elevator car returns to the floor at ambient atmospheric pressure, the pressure within the elevator car decreases, either substantially to ambient atmospheric pressure or to a pressure between the elevated pressure and ambient atmospheric pressure.

13 Claims, 5 Drawing Figures

FIG. 1
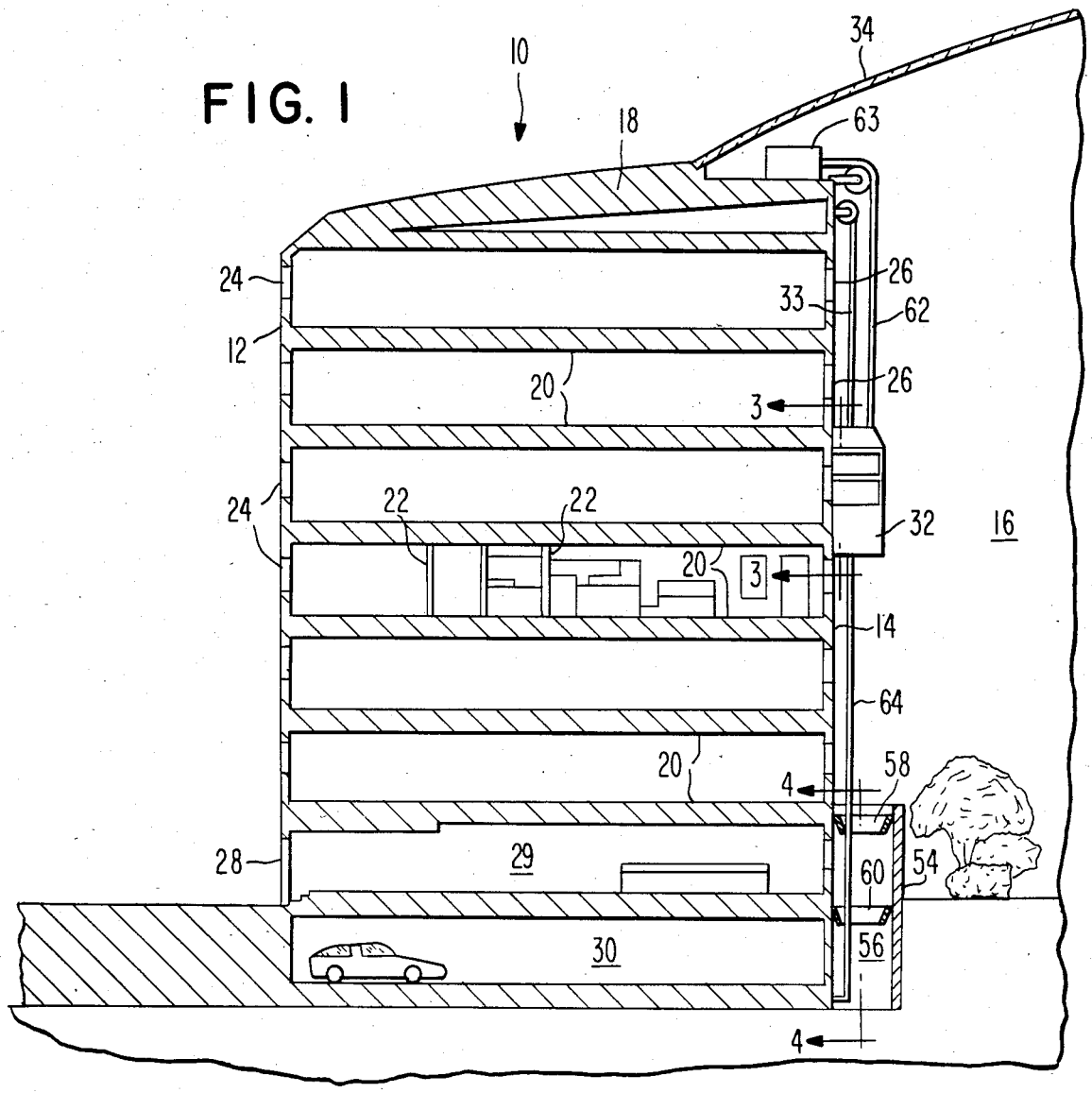
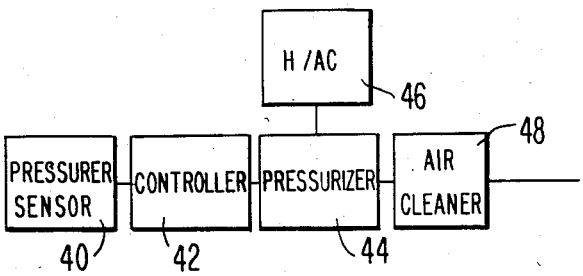
FIG. 2
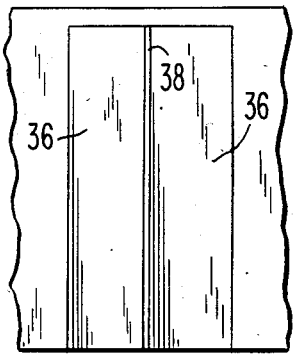
FIG. 3

ELEVATOR AIR LOCK

BACKGROUND OF THE INVENTION

The present invention pertains to controlled chambers for preventing the rapid passage of air between an enclosed area having a controlled air pressure and a second area having a second air pressure. More particularly, the present invention pertains to an elevator air lock permitting free passage between an enclosed area having a first ambient air pressure and an adjacent environment having a second ambient air pressure, without the rapid passage of air therebetween.

While considerable progress has been made in the design of structures having controlled interior temperatures and air pressures, and particularly in the design of structures supported by greater-than-atmospheric interior pressures, little advancement has been achieved in containing pressurized air within the interior of the controlled structure while providing facilitated ingress and egress to and from the structure. Without such control, buildings having interior pressures differing substantially from those of the outside undergo sudden air movement between the interior environment and the outside environment whenever entry to or exit from the building is sought.

Revolving doors can provide ingress and egress for people to a building having an interior air pressure different from that of the building exterior. However, revolving doors severely limit the rate at which people can enter and leave the building. Consequently, at periods of heavy pedestrian traffic, secondary doors, frequently placed next to the revolving doors, are often used. The opening of these secondary doors destroys the air pressure control between the areas of differing pressures and results in a sudden rush of air from the area of relatively higher pressure to the area of relatively lower pressure.

Various arrangements comprising multiple sets of doors defining a pressure stabilization chamber can be used to provide air pressure control between areas of different pressures. To be effective, however, such arrangements require that at least one set of the doors be closed at all times, thus requiring that the doors first opened on one side of the chamber must be closed before the second set of doors, on the other side of the chamber, are opened, again slowing ingress and egress during times of heavy pedestrian traffic.

SUMMARY OF THE INVENTION

The present invention is a controlled chamber for controlling air pressure during ingress and egress between an enclosed area having a first air pressure and an adjacent area having a second air pressure, without permitting rapid air flow between the two areas. In accordance with the present invention an elevator car, which reciprocally moves along an elevator shaft, is utilized as a controlled chamber or air lock to prevent the sudden passage of air into or out of a protected area within a building. The present invention prevents any sudden passage of air between the protected area and an adjacent area regardless of the volume of pedestrian traffic. The elevator air lock comprises the principal entrance/exit to the controlled area, and one or a plurality of elevator air locks in accordance with the present invention are provided as required to accommodate the traffic entering and exiting the building. The elevator air lock of the present invention includes an elevator car adapted to move reciprocally along an elevator shaft. An air pressure control system pressurizes or depressurizes the interior of the elevator car in accordance with the destination of the car along the shaft.

Substantially air-tight elevator car doors isolate the interior of the car to permit pressurization or depressurization of the car interior to a pressure substantially equalling that of the car's destination. Substantially air-tight elevator shaft doors separate the areas of relatively higher pressures from the areas of relatively lower pressures during the absence of the elevator car from a particular elevator car entry/exit location. In the presence of the elevator car, an elevator shaft pressure seal maintains isolation between the relatively high and relatively low pressure areas as the elevator car and elevator shaft doors are opened to permit ingress or egress to the elevator car. Persons desiring to enter the building pass through an elevator lobby isolated from the interior pressure of the remainder of the building. The elevator lobby has a pressure substantially equalling that outside the building, and while positioned at the lobby level, the elevator car assumes a like interior pressure. As the car proceeds to another selected floor, the car interior is pressurized to that of the selected floor. Conversely, the elevator car is depressurized as it returns from another floor to the elevator lobby.

BRIEF DESCRIPTION OF THE DRAWINGS

These and other aspects and advantages of the present invention are more apparent from the following detailed description and claims, particularly when considered in conjunction with the accompanying drawings in which like parts bear like reference numerals. In the drawings:

FIG. 1 is a fragmentary vertical cross-sectional view depicting an air supported building incorporating an elevator-air lock in accordance with the present invention;

FIG. 2 is a block diagram of an air control system, including heating, air conditioning, pressurization, and filtration, suitable for use in a building in accordance with the present invention;

FIG. 3 is an enlarged fragmentary view taken generally along line 3—3 of FIG. 1;

DESCRIPTION OF THE PREFERRED EMBODIMENT

Figure 4:
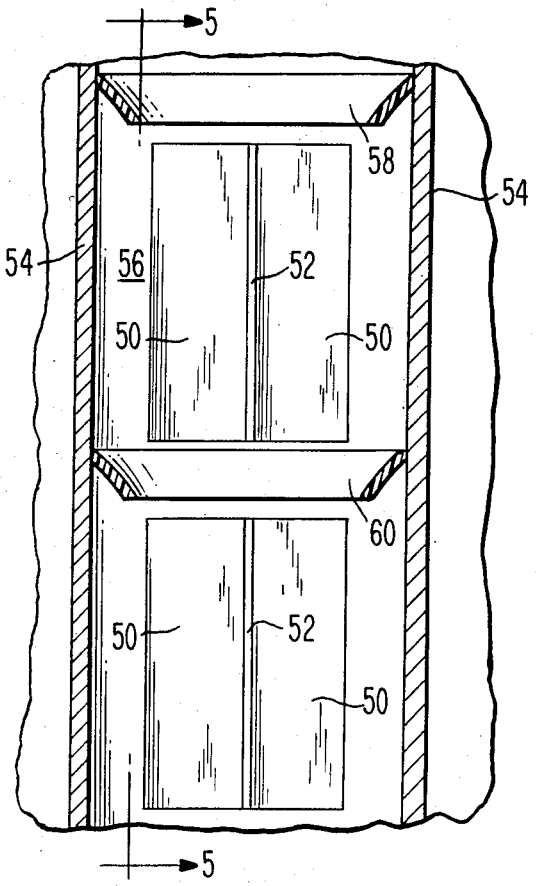
FIG. 4 is an enlarged fragmentary view taken generally along line 4—4 of FIG. 1.

FIG. 1 depicts a building 10 which, by way of example, might be an apartment building, a commercial building, or a professional or office building. Building 10 can be circular, rectangular, square or other desired shape and includes an outer circumferential wall 12, forming the outer building perimeter and defining the building exterior, and an inner circumferential wall 14, defining an atrium 16 within building 10. A substantially rigid roof 18, of generally conventional design, bridges outer wall 12 to inner wall 14. A number of floors 20 are positioned at different vertical levels within building 10. As illustratively depicted on the fourth floor of building 10, each floor is provided with several walls 22 to define the building as a multi-story, multi-unit building. A number of fenestrations are provided in both outer circumferential wall 12 and inner circumferential wall 14. Thus, for example, one or more windows 24 are provided in outer circumferential wall 12 at each floor 20 of the building, and likewise one or more windows 26 are provided in inner circumferential wall 14 at each floor 20. An entrance 28 is provided through outer circumferential wall 12 at the ground floor level 29 of building 10 to permit people to enter and leave the building. Alternatively, entering and leaving of the building can be through a basement garage 30 or other basement level entrance and exit.

FIG. 1 depicts an elevator car 32 moving vertically on inner circumferential wall 14 and within atrium 16 to provide access to the several floors 20 of building 10. Such open elevators are well known, for example in hotels. Atrium 16 is covered by a roof 34 which can be a flexible, continuous membrane, air-supported roof, formed for example of Owens-Corning Structo-Fab fabric, a material formed of glass fiber yarn and fluorocarbon resin and available from Owens-Corning Fiberglas Corporation. Such a roof is preferably semi-opaque to allow passage of diffused sunlight, allowing various plants to grow, while inhibiting passage of direct sunlight. Atrium 16, and thus roof 34, can be of any desired size. An atrium of three to four acres can be accommodated in a building having in the order of about forty to fifty residential apartment units on each floor 20.

Building 10 is provided with an air pressurization system which, as depicted in FIG. 2 can include a pressure sensor 40 which senses the ambient atmospheric pressure outside building 10 to provide an indication of that atmospheric pressure to controller 42. Pressurizer 44, which can be a conventional fan for the building heating and air conditioning system, is controlled by controller 42 to maintain the air pressure within building 10 and atrium 16 at the desired level. A heating and air conditioning unit 46 is also connected to fan 44 to control the temperature and humidity within the common areas of building 10 and within atrium 16. A filter or air cleaner 48 is preferably provided to remove pollen and other pollutants from the air supplied to building 10 and atrium 16. Controller 42 preferably maintains the air pressure within building 10 and atrium 16 slightly above ambient atmospheric pressure, while distributing the heating and/or cooling air from unit 46. If roof 34 is a flexible, continuous membrane roof, then this elevated air pressure maintains roof 34 in the desired inflated configuration. When thus inflated, roof 34 can be of a dome shape, a hyperbolic paraboloidal shape, or some other desired shape. Because building 10 is not air tight, the air pressure differential between the elevated pressure of the building interior and atrium 16 and the ambient atmospheric pressure outside the building results in a substantially continuous flow of the air from the interior of the building to the outside. This inhibits entry of pollen or other pollutants into the building.

If no transition chamber or air lock were provided between the interior of building 10 and the outside, every time a door was opened between the building interior and the outside, air would rush through the door from the higher pressure within the building to the lower pressure outside. Elevator car 32, vertical movement of which is controlled by cable 33 and a motor (not shown), serves as an air lock for this purpose. As seen in FIG. 3, elevator car 32 has doors 36 which are provided with air seal 38 to substantially seal the interior of car 32 when doors 36 are closed, permitting the elevator car interior to be at a different pressure than its exterior. Likewise, as illustrated in FIG. 4, elevator shaft doors 50, provided with air seal 52, are provided at each floor 20. As in conventional elevators, when elevator car 32 is stopped at a floor 20, elevator car doors 36 and elevator shaft doors 50 can open in concert, to permit passage between the floor 20 and the interior of the elevator car, and can close in concert, following which elevator car 32 can move to a different floor, with elevator shaft doors 50 remaining closed to seal the floor 20 and with elevator car doors 36 closed to seal the interior of the elevator car.

Figure 5:
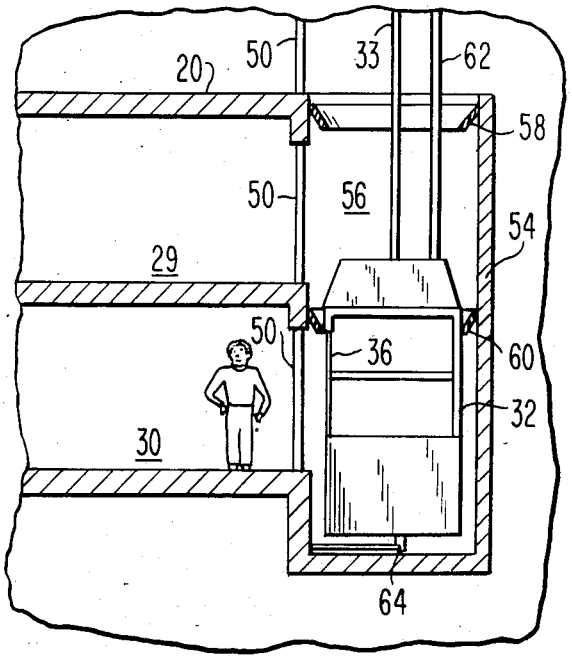
FIG. 5 is a fragmentary view taken generally along line 5—5 of FIG. 4, but depicting the elevator car at the basement garage level of the building.

As seen particularly in FIGS. 1, 4 and 5, adjacent ground floor level 29 and basement garage level 30, elevator wall 54 is provided to define a chamber 56 for elevator car 32 at those levels. Wall 54 protects people on the ground level of atrium 16 from being injured by elevator car 32 as it descends and ascends and inhibits entry of foreign objects into elevator chamber 56. A flexible, resilient sealing ring 58 is provided around the interior surface of elevator wall 54, adjacent the upper end thereof. A second such sealing ring 60 is provided around the interior surface of wall 54 between ground floor level 29 and basement garage level 30. When elevator car 32 enters chamber 56 as the elevator car descends, the outer surface of the elevator car contacts sealing ring 58. Ring 58 provides a substantially air tight seal between the lower pressure of ground floor level 29 and the increased pressure of atrium 16 when elevator car doors 32 and elevator shaft doors 50 are open. Likewise, during times that elevator car doors 32 and elevator shaft doors 50 are open when elevator car 32 is at basement garage level 30, sealing ring 60 provides a sustantially air tight seal between the lower pressure of garage level 30 and the increased pressure of atrium 16. Sealing rings 58 and 60 are sufficiently resilient that they can flex as the sides of elevator car 32 slide against them during downward and upward movement of car 32, retaining the sealing contact.

Air supply line 62 couples the interior of elevator car 32 to a regulated source of pressurized air 63, while air vent line 64 couples the interior of elevator car 32 to a controlled air vent location at atmospheric pressure (not shown). Air supply line 62 and air vent line 64 extend and retract as needed as elevator car 32 goes up and down. Lines 62 and 64 can be telescoping hoses, accordian fold hoses, reel-mounted hoses, or other suitable lines for this purpose. Since elevator car 32 is within pressurized atrium 16, air supply line 62 and pressurized source 63 can be omitted and a valved opening substituted so that when the valved opening is open the interior of elevator car 32 is brought to substantially the same pressure as the interior of atrium 16. When elevator car 32 is positioned at garage level 30 or ground floor level 29 with doors 36 and 50 open, the interior of car 32 is at atmospheric pressure, just as are garage level 30 and ground floor level 29. When people at one of these levels desire to enter one of the upper floors 20 of building 10 or to enter atrium 16, the people enter elevator car 32 and press the button, or operate the other control, to select the desired floor. Elevator doors 36 then close, and the elevator car ascends to the desired floor, as in a standard elevator. Seals 52 provide air tight sealing of basement garage level 30 and ground floor level 29 to isolate the atmospheric pressure in those areas from the increased pressure within atrium 16. Seals 38 likewise provide an air tight seal of the interior of elevator car 32.

As elevator car 32 ascends above ground floor level 29, the regulated air vent is closed to block vent line 64, and the regulated air source is activated to supply air through supply line 62, bringing the interior of elevator car 32 to the increased pressure of the upper floors 20 and atrium 16, or preferably to a pressure between atmospheric pressure and that elevated pressure so as to provide a smoother transition between the two pressures. Likewise as elevator car 32 descends to ground floor level 29, the pressurized air source is deactivated, blocking air supply line 62, and the regulated air vent is opened, venting the interior of elevator car 32 through air vent line 64 to atmospheric pressure. Thus, the air pressure within elevator car 32 is increased as the elevator car ascends from ground floor level 29 and is decreased as the elevator car descends to the ground floor level. Elevator car 32, therefore, acts as a transition chamber between the elevated air pressure within building 10 and atrium 16 and atmospheric pressure at ground level 29, garage level 30, and outside of building 10. Elevator car 32 further serves as an air lock, preventing a rush of air from the increased pressure area within atrium 16 and upper floors 20 and the atmospheric pressure area of ground level 29, garage level 30, and the building exterior.

Although the present invention has been described with reference to a preferred embodiment, numerous modifications and rearrangements could be made, and still the result would be within the scope of the invention.

What is claimed is:

1. A pressurized multi-story building having a pressure transition chamber and air lock, said building comprising:

a plurality of walls, a roof, and a plurality of floors, all cooperating to define a multi-story building including a ground floor and at least one upper floor;

a pressurization system for pressurizing the interior of at least some of said upper floors to an elevated pressure, above ambient atmospheric pressure, while leaving at least said ground floor substantially at ambient atmospheric pressure;

an elevator system including an elevator car having an elevator door, a plurality of elevator shaft doors, one elevator shaft door positioned at each floor of the multi-story building, and means mounting said elevator car for movement to positions corresponding to each floor of the multi-story building with the elevator car door adjacent the elevator shaft door of the floor, said elevator car door and the elevator shaft door for such floor then being openable and closable in concert to permit passage between such floor and the interior of the elevator car;

first sealing means providing a substantially airtight seal on said elevator car door when said elevator car door is closed;

second sealing means providing a substantially airtight seal on the elevator shaft doors of at least those floors at substantially ambient atmospheric pressure when such elevator shaft doors are closed;

pressurization means for pressurizing the interior of said elevator car to a pressure above ambient atmospheric pressure as said elevator car moves from a floor at ambient atmospheric pressure to a floor at said elevated pressure; and depressurizing means for depressurizing the interior of said elevator car from said elevated pressure as said elevator car moves from a floor at said elevated pressure to a floor at ambient atmospheric pressure;

whereby, with said elevator car at a floor at ambient atmospheric pressure and with the elevator shaft door of such floor and the elevator car door open, the elevator car interior is substantially at ambient atmospheric pressure and when the elevator car door and the last-named elevator shaft door then close and the elevator car moves to a floor at said elevated pressure, the elevator car interior is pressurized to a pressure above ambient atmospheric pressure, and with said elevator car at a floor at said elevated pressure and with the elevator shaft door of such floor and the elevator car door open, the elevator car interior is substantially at said elevated pressure and when the elevator car door and the last-named elevator shaft door then close and the elevator car moves to a floor substantially at ambient atmospheric pressure, the elevator car interior is depressurized so that said elevator car interior serves as a pressure transition chamber as said elevator car moves between a floor substantially at ambient atmospheric pressure and a floor at said elevated pressure, and said elevator car serves as an air lock inhibiting air flow between locations substantially at ambient atmospheric pressure and locations within said building at said elevated pressure.

2. A building as claimed in claim 1 in which said plurality of walls, roof, and plurality of floors all cooperate to define a multi-story building having an atrium within it, said roof including a roof portion over said atrium.

3. A building as claimed in claim 2 in which said mounting means mounts said elevator car for movement within said atrium to said positions.

4. A building as claimed in claim 2 in which said atrium is at said elevated pressure.

5. A building as claimed in claim 4 in which said roof portion over said atrium is an air-inflated roof portion.

6. A building as claimed in claim 4 in which said mounting means mounts said elevator car for movement within said atrium to said positions.

7. A building as claimed in claim 6 in which said elevator system further includes an elevator wall cooperating with one of said plurality of walls to substantially enclose said elevator car when said elevator car is at a position corresponding to a floor substantially at ambient atmospheric pressure, said elevator wall including sealing means for substantially sealing the last-named floor and said elevator car interior from said atrium when said elevator is at said last-named floor.

8. A building as claimed in claim 1 including a plurality of said elevator systems at a plurality of locations of said building.

9. A building as claimed in claim 1 in which said pressurization means pressurizes the interior of said elevator car substantially to said elevated pressure and said depressurization means depressurizes the interior of said elevator car substantially to ambient atmospheric pressure.

10. A building as claimed in claim 1 in which said pressurization means pressurizes the interior of said elevator car to a pressure between ambient atmospheric pressure and said elevated pressure and said depressurizaton system depressurizes the interior of said elevator car to a pressure between said elevated pressure and ambient atmospheric pressure.

11. A method of controlling the air pressure within and air flow from a pressurized multi-story building having a ground floor and at least one upper floor, with at least the ground floor substantially at ambient atmospheric pressure and at least some of the upper floors at an elevated pressure above ambient atmospheric pressure, and having an elevator system including an elevator car movable to positions corresponding to each floor of the multi-story building, such elevator car including an elevator car door, each floor having an elevator shaft door operable and closable in concert with the elevator car door when the elevator car is at the position corresponding to such floor, said method comprising:

(a) when the elevator car is at a position corresponding to a floor substantially at ambient atmospheric pressure with the elevator shaft door of such floor and the elevator car door open so that the elevator car interior is substantially at ambient atmospheric pressure and it is desired to move the elevator car to a floor at the elevated pressure, (i) closing the open elevator shaft door and the elevator car door in concert to substantially seal such floor and to substantially seal the elevator car interior;

(ii) moving the elevator car to the position corresponding to the desired floor;

(iii) while the elevator car is thus moving, increasing the pressure within the elevator car; and (iv) upon the elevator car reaching the position corresponding to the desired floor, opening the elevator shaft door of the desired floor and the elevator car door in concert; and (b) when the elevator car is at a position corresponding to a floor at the elevated pressure with the elevator shaft door of such floor and the elevator car door open so that the elevator car interior is substantially at the elevated pressure and it is desired to move the elevator car to a floor substantially at atmospheric pressure, (i) closing the open elevator shaft door and the elevator car door in concert to substantially seal the elevator car interior;

(ii) moving the elevator car to the position corresponding to the desired floor;

(iii) while the elevator car is thus moving, decreasing the pressure within the elevator car; and (iv) upon the elevator car reaching the position corresponding to the desired floor, opening the elevator shaft door of the desired floor and the elevator car door in concert.

12. A method as claimed in claim 11 in which said pressure increasing step comprises increasing the pressure within the elevator car substantially to said elevated pressure, and said pressure decreasing step comprises decreasing the pressure within the elevator car substantially to ambient atmospheric pressure.

13. A method as claimed in claim 11 in which said pressure increasing step comprises increasing the pressure within the elevator car to a pressure between ambient atmospheric pressure and said elevated pressure and said pressure decreasing step comprises decreasing the pressure within the elevator car to a pressure between said elevated pressure and ambient atmospheric pressure.

* * * * *